United States Patent [19]

Buchfink

[11] Patent Number: 4,506,985

[45] Date of Patent: Mar. 26, 1985

[54] MIXING CHAMBER SILO FOR LOOSE MATERIAL

[75] Inventor: Adolf Buchfink, Plano, Tex.

[73] Assignee: Claudius Peters AG, Fed. Rep. of Germany

[21] Appl. No.: 496,477

[22] Filed: May 20, 1983

[51] Int. Cl.[3] ..... B01F 13/02

[52] U.S. Cl. ..... 366/107; 366/132; 366/142; 366/152; 366/153; 366/193

[58] Field of Search ..... 366/101, 106, 107, 132, 366/134, 142, 151, 153, 184, 192, 193

[56] References Cited

U.S. PATENT DOCUMENTS 4,184,774 1/1980 Krauss ..... 366/107
4,239,421 12/1980 Krauss ..... 366/107
4,375,335 3/1983 Klein-Albenhausen ..... 366/132
4,398,828 8/1983 Kluger et al. ..... 366/193

*Primary Examiner*—Robert W. Jenkins
*Assistant Examiner*—Arthur D. Dahlberg
*Attorney, Agent, or Firm*—Eric P. Schellin

[57] ABSTRACT

A mixing chamber silo is described for loose material with a mixing chamber on the silo floor and with a passage between the central mixing compartment and the outer wall of the silo through which the mixed loose material is removed. The passage has a dividing wall between the central mixing compartment and a conduit under the chamber ceiling. Only mixed loose material passes through this opening to conduit and then to the removal outlet. There is no direct connection from the silo area to the removal outlet.

3 Claims, 1 Drawing Figure

MIXING CHAMBER SILO FOR LOOSE MATERIAL

FIELD OF THE INVENTION

This invention pertains to a silo for loose material with a chamber in which the loose material is mixed.

BACKGROUND OF THE INVENTION

Silos with mixing chambers are used to thoroughly mix loose material flowing from the silo. Such mixing chambers homogenize the loose material eliminating variations in production of the loose material. By integrating the mixing chamber and the silo, the need for additional homogenizing silos is eliminated.

French Pat. No. 70.39327 shows such a silo in which the removal device is connected in the middle of the mixing chamber. Dust is removed from the mixing chamber over a central pipe and is emptied below. An additional emptying occurs over this pipe in the upper chamber area. The loose material is then guided under the silo floor through an underpass to the side exit. A complicated central column in the construction unit is required in this construction.

The silos of German Federal Republic applications DT-OS No. 26 57 596 and DT-OS No. 26 57 597 have a better side discharges over a conduit running to the silo wall which terminates at the top at the height of the chamber and over which the dust is passed to a dust-removal tube which is attached to the outer wall of the silo. In both instances, the side conduit is separated from the mixing chamber by an intermediary wall. Dust is removed from the mixing chamber over a opening in this wall located under the ceiling and the loose material flows from the mixing chamber into the side conduit over a second opening located at the bottom of this dividing wall. The flow speed of the loose material and the filling height of the side conduit depend on the cross section of this opening and on the removal capacity of the silo.

It is possible that the loose material flowing from the silo over the infeed openings of the mixing chamber can flow partially over the shortest path to the side conduit and not participate in the homogenizing in the mixing chamber.

SUMMARY OF THE INVENTION

This invention has the task of preventing this short-circuit flow in a mixing chamber with a conduit running radially to the silo wall.

This invention solves this task as follows. The loose material flows to the conduit over an opening located at the top under the chamber ceiling. The loose material flowing into the mixing chamber from the silo area must flow at least vertically or diagonally through the mixing chamber before it reaches the side conduit. It is securely caught by the circulating homogenizing flow and mixed with the rest of the loose material in the mixing chamber. This makes the mixing of the finished material more homogeneous. The degree of varation of the finished material is decreased because individual exceptions due to short-circuit flows do not occur.

The invention assures that a compulsory path with the greatest possible distance is produced between the inlet openings of the mixing chamber and the loose material exit from the chamber into the side conduit. The amount of air of the active blower of the mixing chamber homogenizing system can also be decreased in this way, as the circulation speed is now only for the required homogenization and no longer for the rapid inclusion of the loose material which flow in later.

An improvement is achieved by making the lower edge of the exit opening from the mixing chamber to the conduit adjustable in height. Thus, the mixing chamber does not always have to be filled to the greatest possible filling height until the loose material flows over into the conduit. This also makes it possible to adapt the overflow height during operation to the most advantageous filling height of the mixing chamber with which a good mixing result is achieved.

A lower filling height in the mxing chamber directly entails a saving of energy, since the blowers present then have to supply a lower pressure and the drive motors require less current with electric drive.

The filling height of the mixing chamber is affected by the amount of loose material fed in and removed. The removal of loose material from the side conduit goes according to need and therefore varies. An even removal is assured by the constant filling height of the conduit and an even floor ventilation. According to a special feature of the invention, this filling height is monitored by a measuring means which controls the ventilation of the silo floor outside the mixing chamber, therewith assuring the fill height in the mixing chamber and an even overflow into the conduit.

This control also reduces the ventilation expense for the silo floor outside of the chamber to a required minimum.

If the side exit of the silo should not be on the floor, but higher, the floor of the conduit is set higher than the floor of the mixing chamber. Less blower pressure for ventilating the chamber floor is also needed in this embodiment, which also saves energy.

It is also provided that the mixing chamber has a second removal outlet on its floor through which loose material is removed. This outlet constitutes an emergency exit in case of trouble. There is the possibility of a completely emptying the coarse portions in the loose material which separate in the mixing chamber from below.

A particularly simple construction results if the front connection of the second removal outlet on the floor of the mixing chamber runs under the conduit.

These and further operational and constructional characteristics of the invention will be more evident from the detailed description given hereinafter with reference to the accompanying drawing which illustrates one preferred embodiment by way of non-limiting example.

DESCRIPTION OF THE PREFERRED EMBODIMENT

Figure 1:
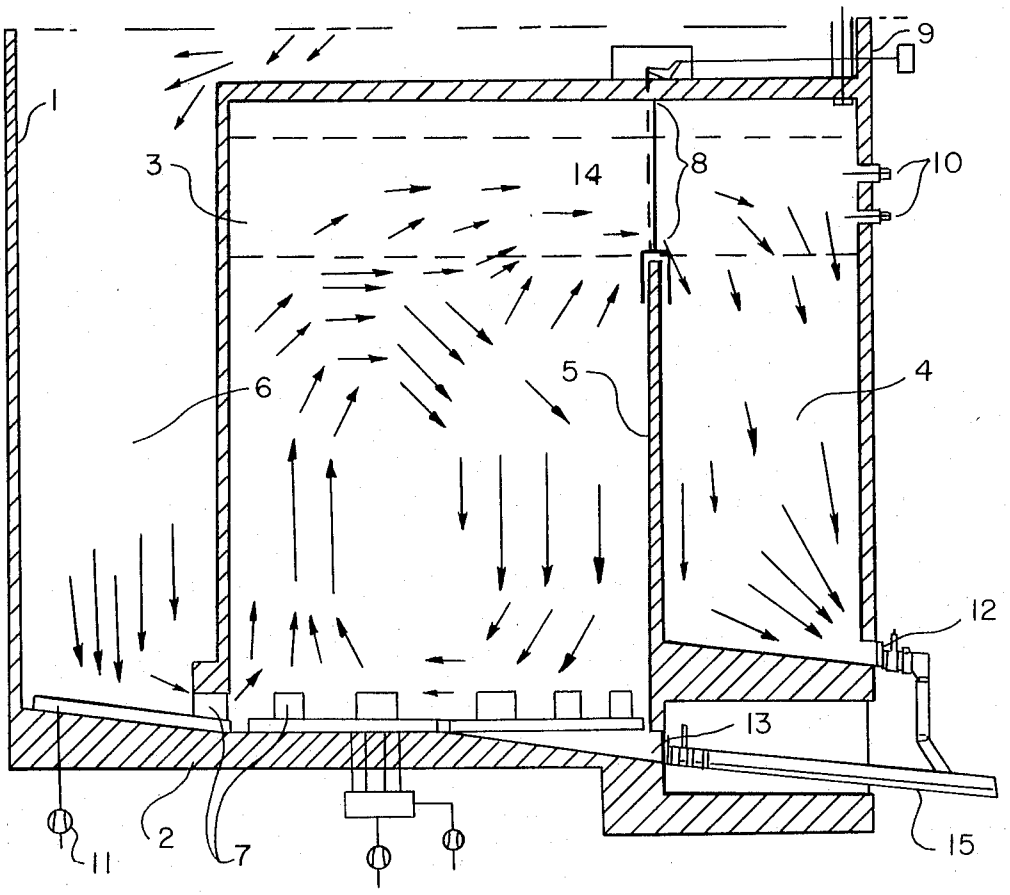
FIG. 1 shows a section through the mixing chamber below the silo.

The lower area of a storage silo for loose material is limited by outer wall 1 and floor 2.

Central mixing compartment 3 is centrally located on the floor of this silo, and conduit 4 is located between this compartment and the outer wall of the silo, which is separated from central mixing compartment 3 by wall 5. The loose material in the silo passes through openings 7 and area 6 into central mixing compartment 3, where it is mixed according to the quadrant homogenizing method. One active quadrant is heavily ventilated and three inactive quadrants are ventilated less. The loose material is circulated. The quadrant ventilation is alternated in a time pattern, so that each quadrant is ventilated actively in sequence.

The loose material enters passage 14 and passes over opening 8 into conduit 4 and the dust-removal air to dust-reoval line 9.

Measuring means 10 scans the filling state in conduit 4 and controls blower 11.

The loose material is removed over removal outlet 12. The second removal point in the mixing chamber is at second removal outlet 13. Conveyer connection 15 from the second removal outlet 13 runs under conduit 4.

This invention is not limited to the single embodiment heretofore described, to which variations and improvements may be made, consisting of mechanically equivalent modifications to component parts, without leaving the scope of protection of the present patent, the characteristics of which are summarized in the following claims.

What is claimed is:

1. An assembly comprising:

a silo; for storing bulk materials; and a mixing chamber for bulk materials located on the floor of said silo, said mixing chamber having a principal passage for removal of bulk materials from a central mixing compartment, said passage running radially to an outer wall of the silo, said passage being located at the top of said mixing chamber, said passage is defined by an opening in a wall between said central mixing compartment and a conduit connecting said central mixing compartment to a removal outlet, said opening is provided with a lower edge which can be vertically adjusted, the filling height of said conduit is monitored by measuring means which controls the ventilation of the silo floor outside said mixing compartment, said central mixing compartment has on its floor a second removal outlet through which loose material is removed.

2. An assembly as in claim 1 where the floor of said conduit is higher than the floor of said central mixing compartment.

3. An assembly as in claim 1 where a conveyer connection from the second removal outlet runs under said conduit.

* * * * *